United States Patent [19]

Weinerman et al.

[11] Patent Number: 4,912,951

[45] Date of Patent: Apr. 3, 1990

[54] SLIDING DOOR LOCK

[75] Inventors: Lee S. Weinerman, Medina; Joel T. Vargus, Middleburg Heights, both of Ohio

[73] Assignee: The Eastern Company, Cleveland, Ohio

[21] Appl. No.: 304,957

[22] Filed: Feb. 1, 1989

[51] Int. Cl.[4] ..... E05B 65/08

[52] U.S. Cl. ..... 70/99; 70/100

[58] Field of Search ..... 70/77, 78, 81, 90, 95, 70/99, 100, 91

[56] References Cited

U.S. PATENT DOCUMENTS

| | | | |
|---|---|---|---|
| D. 265,965 | 8/1982 | Davis et al. | D8/302 |
| D. 270,328 | 8/1983 | Davis et al. | D8/302 |
| 767,567 | 8/1904 | Keil . | |
| 824,027 | 6/1906 | Keeler . | |
| 1,035,073 | 8/1912 | Augenbraun | 70/150 |
| 2,475,951 | 7/1949 | Floraday | 70/139 |
| 2,511,253 | 6/1950 | Fischer | 292/129 |
| 2,530,330 | 11/1950 | Groeger | 292/29 |
| 2,540,686 | 2/1951 | Milburn | 292/124 |
| 3,044,287 | 7/1962 | Pelcin | 70/99 |
| 3,958,308 | 5/1976 | Gooding | 24/221 |
| 4,312,203 | 1/1982 | Davis | 70/472 |
| 4,457,146 | 7/1984 | Weinerman | 70/100 |
| 4,511,166 | 4/1985 | Weinerman | 292/29 |
| 4,565,080 | 1/1986 | Kincaid et al. | 70/215 |
| 4,570,467 | 2/1986 | Greco | 70/99 |
| 4,768,360 | 9/1988 | Foshee | 70/100 |

*Primary Examiner*—Robert L. Wolfe

*Attorney, Agent, or Firm*—David A. Burge

[57] ABSTRACT

A lock or latch for a sliding or rolling type door includes front and rear housing members that clampingly engage opposite sides of a door panel adjacent an opening that is formed through the door panel. Aligned cavities are formed in the front and rear housing members that cooperate with the door panel opening to define a compartment within which a latch bolt member is housed for forward and rearward movement. The latch bolt member has a rearwardly extending formation that projects through a hole formed in the rear housing member for selectively engaging structure located behind the door to releasably latch the door in its closed position. An operating mechanism connects with the latch bolt member and includes components that extend forwardly and rearwardly through aligned openings formed through the front and rear housing members to provide means (1) for moving the latch bolt member forwardly and rearwardly relative to the housing members between unlatched and latched positions, and (2) for releasably retaining the latch bolt member its unlatched and latched positions. The operating mechanism preferably includes a forwardly facing key operated lock cylinder that is housed in a forwardly facing push button, and a foldable handle that faces rearwardly. The push button and the key cylinder are accessible from the front side of the lock for operating the latch bolt member. The foldable handle is accessible from the rear side of the lock for operating the latch bolt member.

34 Claims, 7 Drawing Sheets

SLIDING DOOR LOCK

CROSS-REFERENCE TO RELATED APPLICATIONS

Reference is made to the following related, concurrently-filed design applications, the disclosures of which are incorporated herein by reference:

LATCH OR LOCK HOUSING WITH PUSH BUTTON OPERATOR, Ser. No. 305,011 filed (concurrently herewith) by Lee S. Weinerman and Joel T. Vargus; and, LATCH OR LOCK HOUSING WITH FOLDABLE HANDLE, Ser. No. 305,010 filed (concurrently herewith) by Lee S. Weinerman and Joel T. Vargus.

BACKGROUND OF THE INVENTION

1. Field of the Invention

The present invention relates to latches and locks for use on sliding or rolling doors of vehicles, industrial cabinets, electrical equipment enclosures and the like wherein there is a need for a closure to be releasably retained in its closed position by the action of a latch bolt that is projectable rearwardly with respect to the closure to engage structure that is situated behind the closure. In preferred practice, the present invention relates to a sliding door lock having a rearwardly projectable latch bolt that can be operated through independent use of (1) a key controlled push button that is accessible from the front of the door, and (2) an operating handle that is accessible from behind the door.

2. Prior Art

While the prior art is replete with latch and lock proposals for closures of the type that slide, roll or otherwise are arranged to move in directions that extend from side to side across openings that are controlled by their respective closures, there remains a need for a simple and relatively inexpensive, yet secure type of latch and lock unit that has housing portions which can be clamped into engagement with front and rear surfaces of a panel portion of a closure, in surrounding relationship to an opening that is formed through the closure panel, and that provides an operating mechanism for moving a rearwardly projectable latch bolt to engage structure that is situated behind the closure to releasably secure the closure in its closed position.

SUMMARY OF THE INVENTION

The present invention addresses the foregoing and other needs by providing novel and improved latch and lock units for closures of the sliding or rolling type.

A feature of a latch or lock that embodies the present invention resides in its use of a pair of relatively thin front and rear housing members that overlie front and rear portions of a closure panel, respectively, and that cooperate with an appropriately configured opening which is formed through the closure panel to define a compartment that houses a latch bolt, which, together with a very limited number of other components that are connected to the latch bolt, provide a simple yet reliable operating mechanism. In preferred practice, the rear housing member is especially thin and is mounted so as to extend into a cavity that is defined by the closure panel, whereby the resulting installation is relatively unobtrusive and, in particular, does not project rearwardly very far beyond the rear face of the closure panel.

A further feature of a latch or lock that embodies the present invention resides in its use of a rear housing member having a rearwardly facing surface that provides formations which interact with a latching component of the operating mechanism to releasably retain the latch bolt in its rearwardly projected or "latched" position. In preferred practice, the latching component also defines a foldable operating handle that can be utilized to "latch" and "unlatch" the latch bolt.

In preferred practice, a lock of the type described above has an operating mechanism that includes a forwardly-facing push button control. The push button houses a key cylinder that must be operated in combination with forward and rearward movements of the push button to effect latching and unlatching movements of the latch bolt. A latching component is provided that cooperates with a stepped, rearwardly facing surface of the rear housing member to releasably retain the latch bolt in its latched position. If the latching component includes an operating handle that is accessible from the rear side of the lock, the operating mechanism preferably also includes a "lost motion connection" that is interposed between the key cylinder and the operating handle to enable the operating handle to execute latching and unlatching movements without causing the key cylinder to move correspondingly.

The term "lost motion connection" is a term of art that is well known to those who are skilled in the art. What is referred to by the use of this term in this document is a driving connection that is established between two components—a driving connection that enables one of the components to move through a predetermined portion of its permitted range of movement without causing corresponding movement of the other component, but with movement of the one component beyond the predetermined portion of its range causing corresponding movement of the other component. In lock applications, for example, it is known to utilize a lost motion connection to provide a driving connection between a key cylinder that can be operated from a front side of the lock, and a knob or handle that can be operated from a rear side of the lock, (1) to enable the knob or handle to operate the lock without causing corresponding key cylinder movement, and (2) to enable the key cylinder to both operate the lock and reposition the knob or handle.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
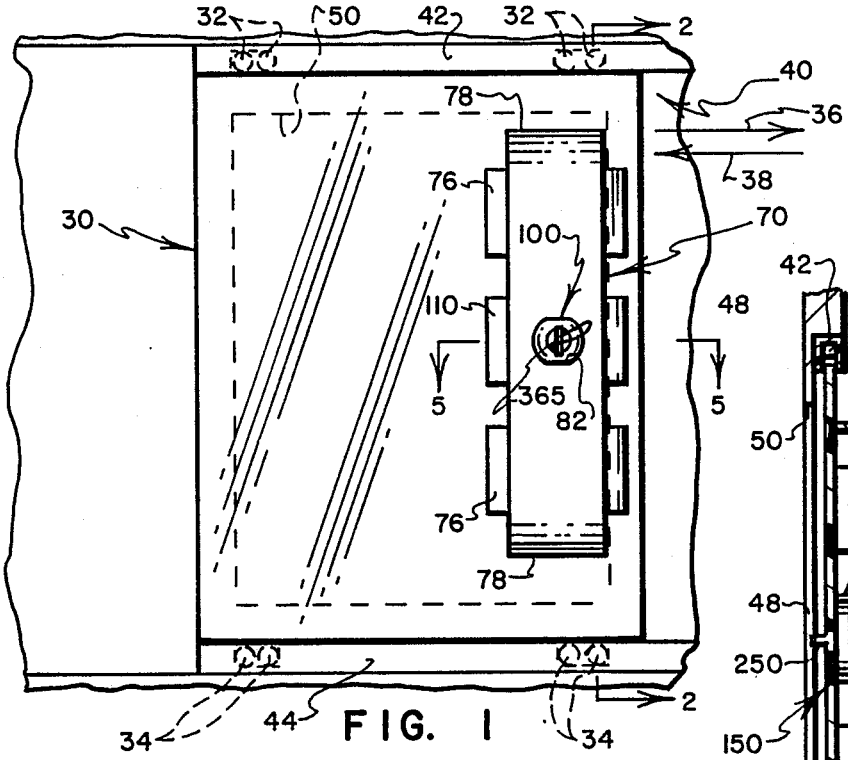
FIG. 1 is a front elevational view of a sliding door that is movable from side to side to open and close an opening that is defined by structure which resides behind the door, with the opening being depicted by hidden lines, with the door being shown in its closed position, and with a lock that embodies the preferred practice of the present invention shown mounted on the door adjacent the door's handle for securing the door in its closed position.

Referring to FIG. 1, a sliding door lock 100 that embodies the preferred practice of the present invention is shown installed on a conventional sliding or rolling door 30 adjacent a door handle 70. The door 30 is shown "closed" with respect to an opening 50 that is depicted by hidden lines. The opening 50 is defined by portions of a structure 40 that reside behind the door 30.

The door 30 is mounted on the structure 40 for side to side movement relative to the opening 50 to "open" the opening 50 as by moving in a rightward direction (as is indicated by an arrow 36 in FIG. 1), and to "close" the opening 50 as by moving leftwardly (as indicated by an arrow 38 in FIG. 1) to return to the closed position that is shown in FIG. 1, whereby access to the opening 50 is controlled by appropriately positioning the door 30.

Figure 2:
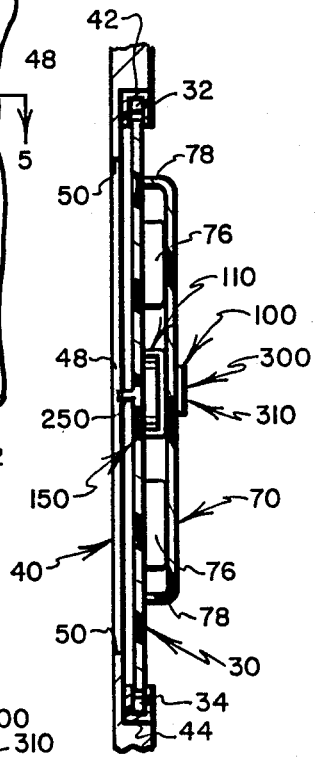
FIG. 2 is a sectional view as seen from a plane indicated by a line 2—2 in FIG. 1.

While the manner in which the door 30 is mounted for movement between its open and closed positions forms no part of the present invention, FIGS. 1 and 2 schematically depict, by way of example, a typical type of roller mounting of the door 30. Conventional rollers 32, 34 are depicted as being situated near top and bottom edges of the door 30, with the rollers 32, 34 extending into conventional channel-shaped tracks 42, 44, respectively. The channel-shaped track members 42, 44 extend above and below the opening 50, respectively, and extend to the right of the opening 50, as viewed in FIG. 1. While what is depicted in FIGS. 1 and 2 is somewhat schematic in character, it will be understood by those skilled in the art that the rollers 32, 34 are connected to the door 30 and are received within the track members 42, 44 so as to guide and support the door 30 for movement from side to side with respect to the opening 50 to enable the door 30 to "open" and "close" the opening 50. Likewise, it will be understood that what is schematically depicted by the rollers 32, 34 may comprise any of a wide variety of commercially available or otherwise conventionally configured hardware for mounting the door 30 for side to side movement with respect to the opening 50.

Referring to FIG. 2, the lock 100 functions to releasably retain the door 30 in its closed position as by providing a latch bolt formation 250 that is projectable rearwardly behind the plane of the door 30 (when the door 30 is closed) to a "latched" position wherein the latch bolt formation 250 extends into engagement with a portion of the structure 40 that is located behind the door 30 to prevent opening movement of the door 30 until the latch bolt formation 250 has been withdrawn to an "unlatched" position out of engagement with the structure 40. Thus, it is the function of the lock 100 to selectively position the latch bolt formation 250 in its "latched" and "unlatched" positions (when the door 30 is closed) to selectively "latch" and "unlatch" the door 30 to selectively prevent and permit opening movements of the door 30 relative to the opening 50.

If desired, the latch bolt formation 250 can extend into the opening 50 when "latched" so as to engage a portion 48 of the structure 40 that extends along the right side of the opening 50, to thereby prevent opening movement of the door 30 until the latch bolt formation 250 is withdrawn to an "unlatched" position wherein it does not project into the opening 50 and thereby poses no obstacle to opening movement of the door 30. Alternatively, if desired, a receiving formation (not shown) can be provided by the structure 40 (preferably at a location near the right side of the opening 50) to receive the latch bolt formation 250 when the door 30 is closed. Moreover, if it is desired to utilize the lock 100 to releasably retain the door 30 in an open position, a suitable receiving formation (not shown) also can be provided by the structure 40 at a location to the right of the opening 50 in alignment with the position that is assumed by the latch bolt formation 250 when the door 30 is in its open position (not shown).

Figure 3:
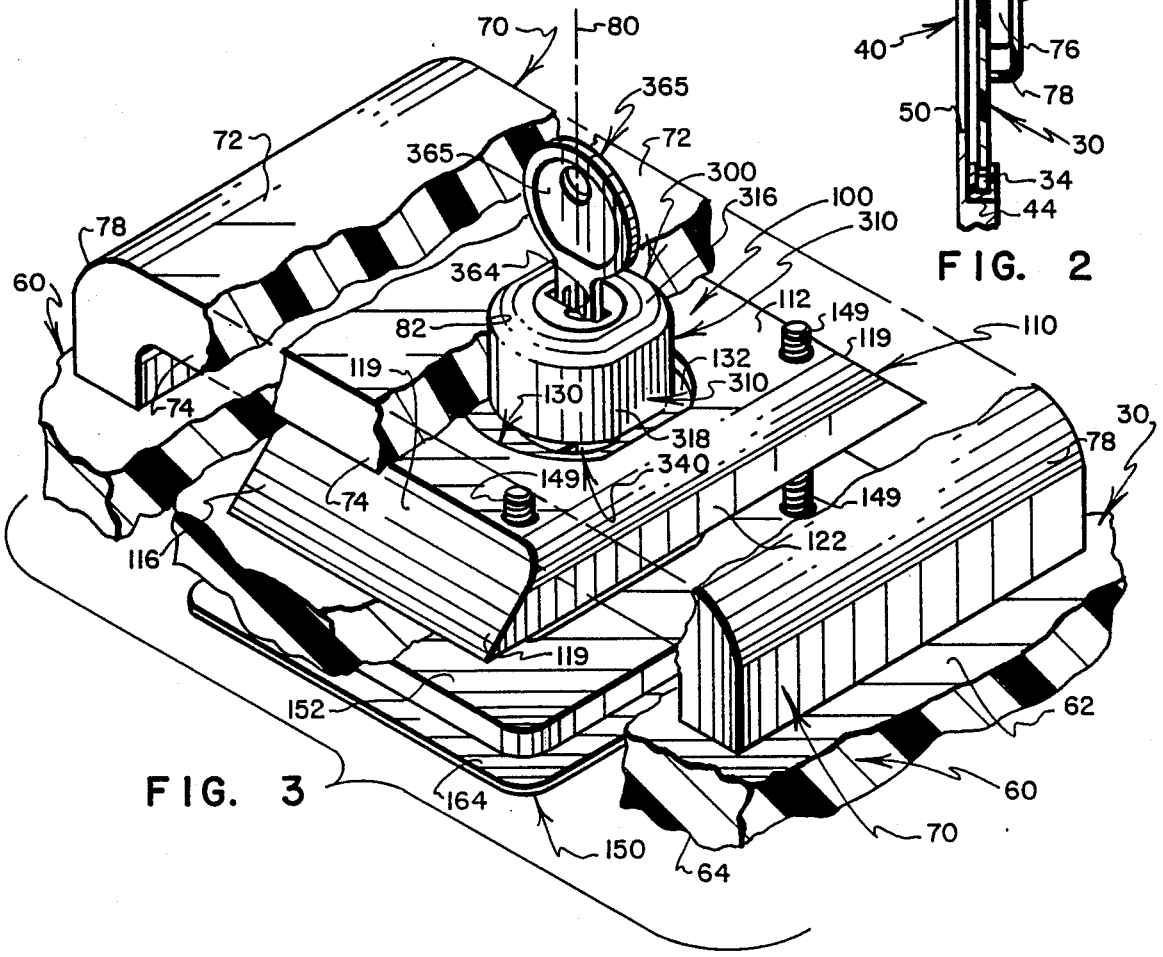
FIG. 3 is a perspective view of forwardly facing portions of the door, the door handle and the lock, on an enlarged scale, with the view also showing a key that has been inserted into a key cylinder of the lock, and with portions of the door, the door handle and the lock being broken away and shown in cross section.
Figure 4:
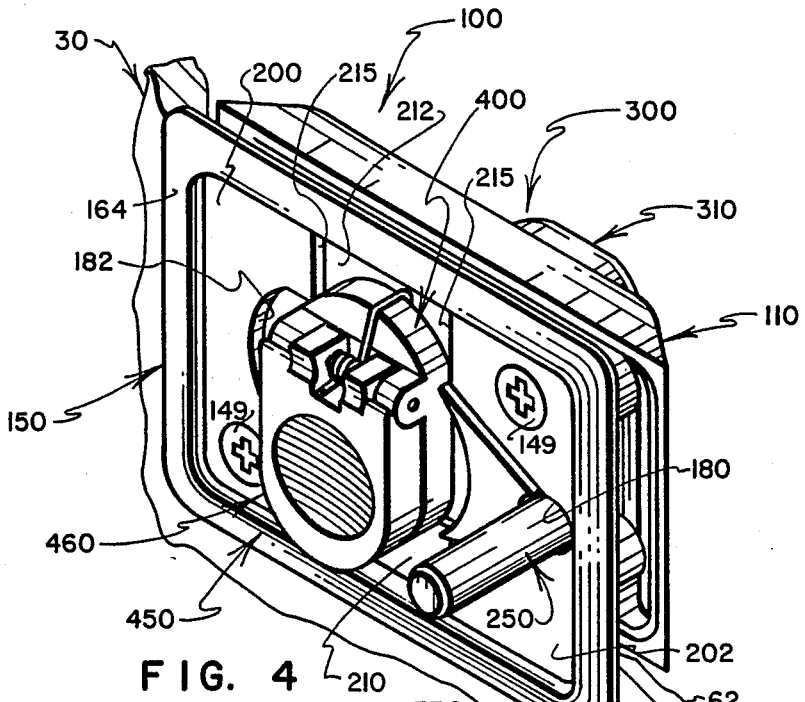
FIG. 4 is a perspective view of rearwardly facing portions of the door and the lock, with portions of the door broken away, with the handle removed, with the latch bolt formation of the lock in its "latched" position, and with the latching member of the lock in its "latching" position.

Referring to FIG. 3, the preferred type of door structure 30 with which the lock 100 is employed includes a door panel 60 that is formed from plastics material having a front face 62 and a rear face 64 that extend parallel to each other, with the panel 60 typically being about one half inch in thickness. The preferred type of handle 70 that is provided on the door 30 includes a strip or bar of plastics material that has a front face 72 and a back face 74 that extend parallel to each other, with the handle 70 typically being about one half inch in thickness. In preferred practice, the back face 74 of the handle 70 extends parallel to the front face 62 of the door panel 60, with a spacing of typically about one half inch therebetween being maintained as by suitably mounting the handle 70 on the door panel 60.

While the configuration and mounting of the handle 70 on the door panel 60 forms no part of the present invention, reference is made to FIGS. 1 and 2 wherein a pair of spacer blocks 76 are shown interposed between the handle 70 and the door panel 60, and wherein the handle 70 is shown as having a pair of curved end formations 78 that extend into abutting engagement with the front face 62 of the door panel 60. Suitable fasteners (not shown) or other means of fastening (such as bonding) may be utilized to rigidly connect the handle 70, the spacer blocks 76 and the door panel 60.

Figure 14:
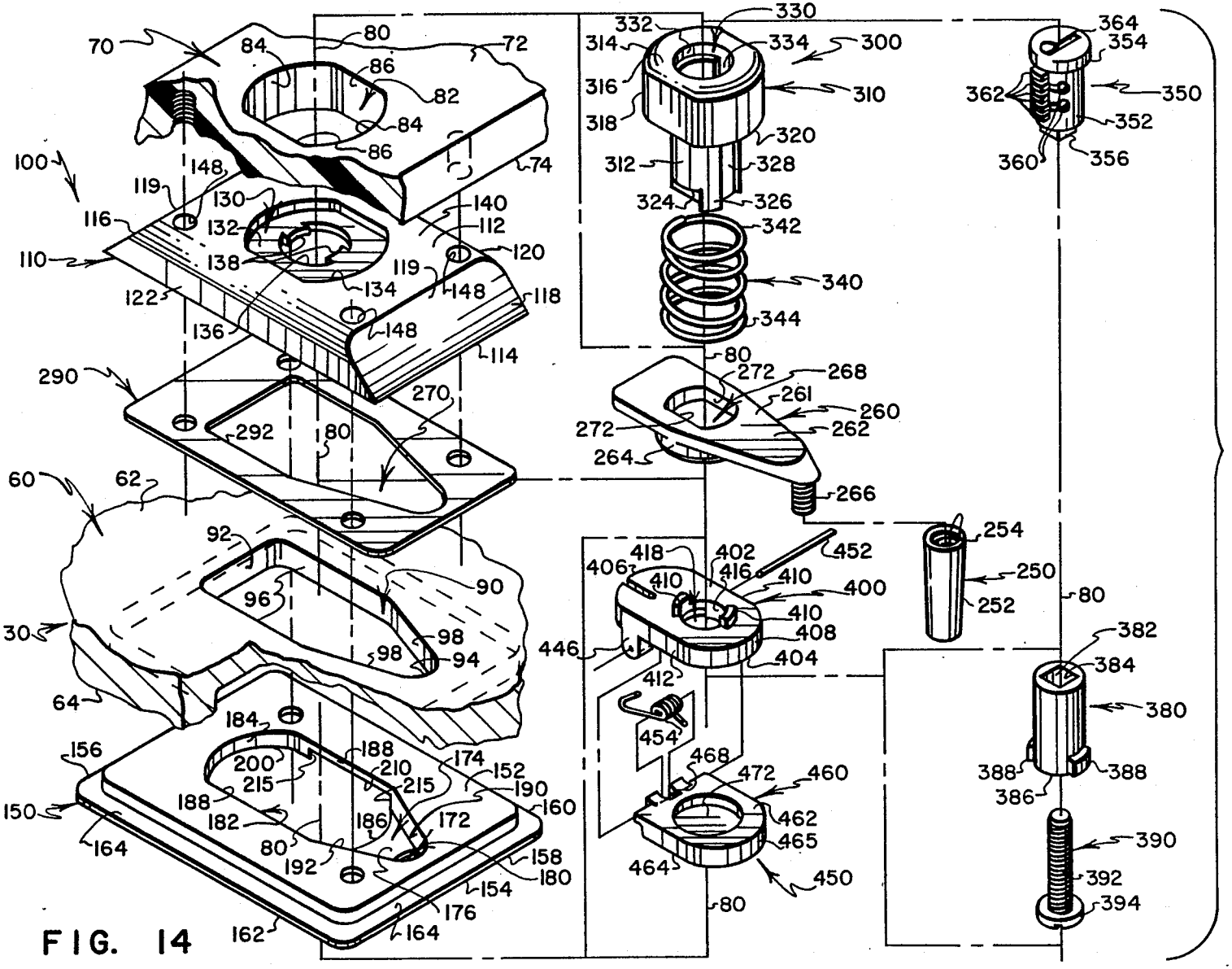
FIG. 14 is an exploded perspective view showing principally forwardly facing portions of components of the lock.

Aligned openings are formed through the handle 70 and through the door panel 60 at the location of mounting of the lock 100. Referring to FIG. 14 wherein portions of the handle 70 and of the door panel 60 are shown, an oblong opening 82 is formed through the handle 70, and a tapered, elongate opening 90 is formed through the door panel 60. The opening 82 has identical curved surfaces 84 at its opposite ends, and has identical straight side surfaces 86 that connect the curved surfaces 84. The opening 90 has curved end surfaces 92, 94 that are connected by pairs of straight surfaces 96, 98. The opening 82 extends through the handle 70 along a central axis that is indicated by the numeral 80. The axis 80 also extends through the opening 90, at a central location between the straight surfaces 96. The opening 90 has an enlarged, rearwardly facing end region 98 (see FIG. 5) that is of generally rectangular configuration and serves to receive portions of a rear housing 150 of the lock 100 (i.e., portions that reside within the confines of a rim 164 that is provided on the rear housing 164 to overlie the rear portion of the opening 98), as will be described later in this document.

Figure 9:
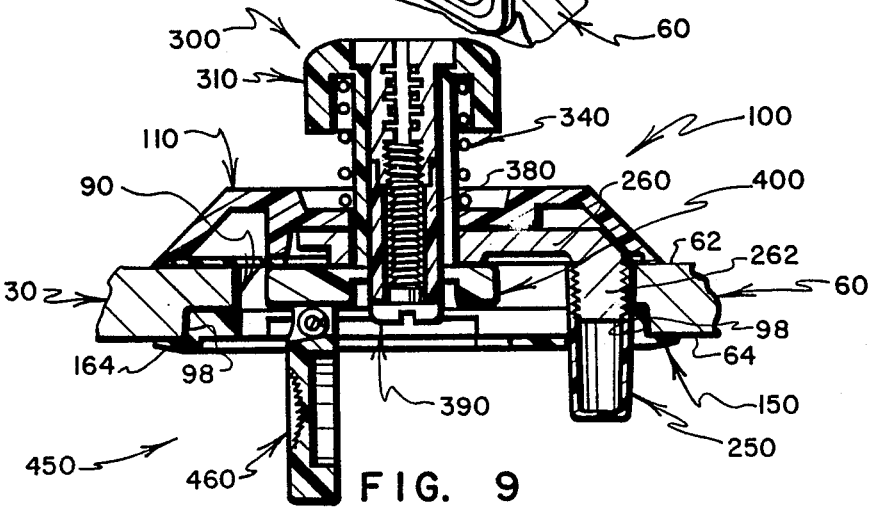
FIG. 9 is a sectional view as seen from a plane indicated by a line 9—9 in FIG. 8.
Figure 10:
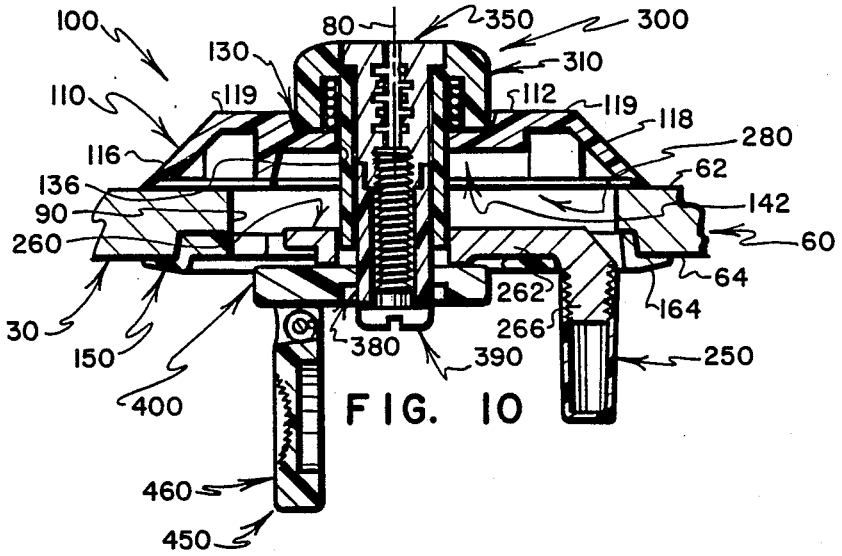
FIG. 10 is a sectional view as seen from a plane indicated by a line 10—10 in FIG. 7.
Figure 11:
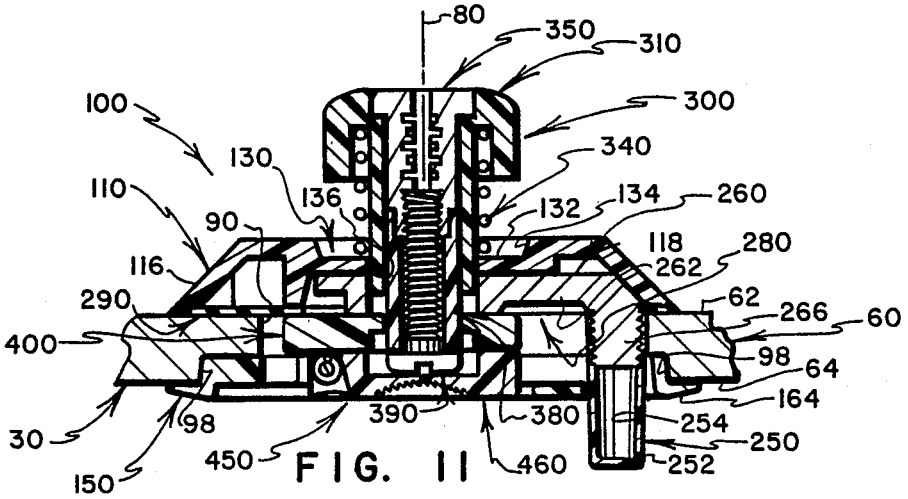
FIG. 11 is a sectional view similar to FIG. 9 but with the foldable operating handle in its retracted position.
Figure 12:
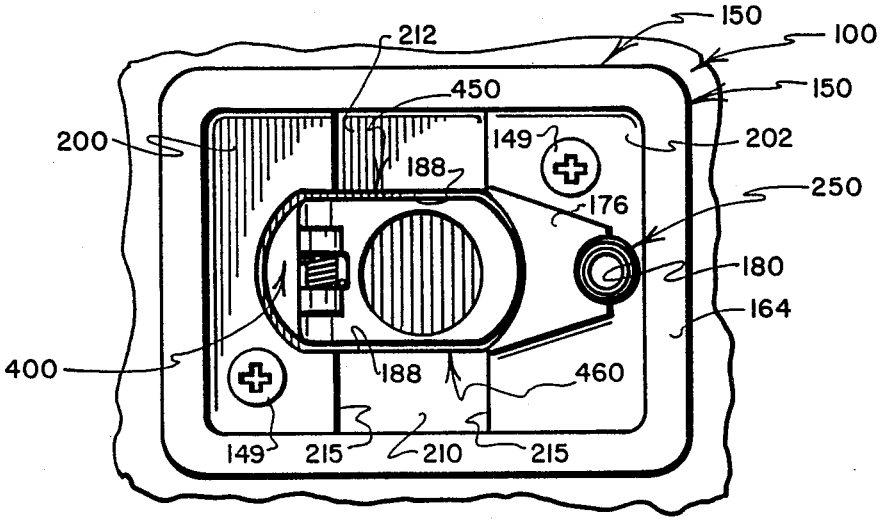
FIG. 12 is a rear elevational view of the lock and surrounding portions of the door, with components of the lock positioned as in FIG. 11.
Figure 13:
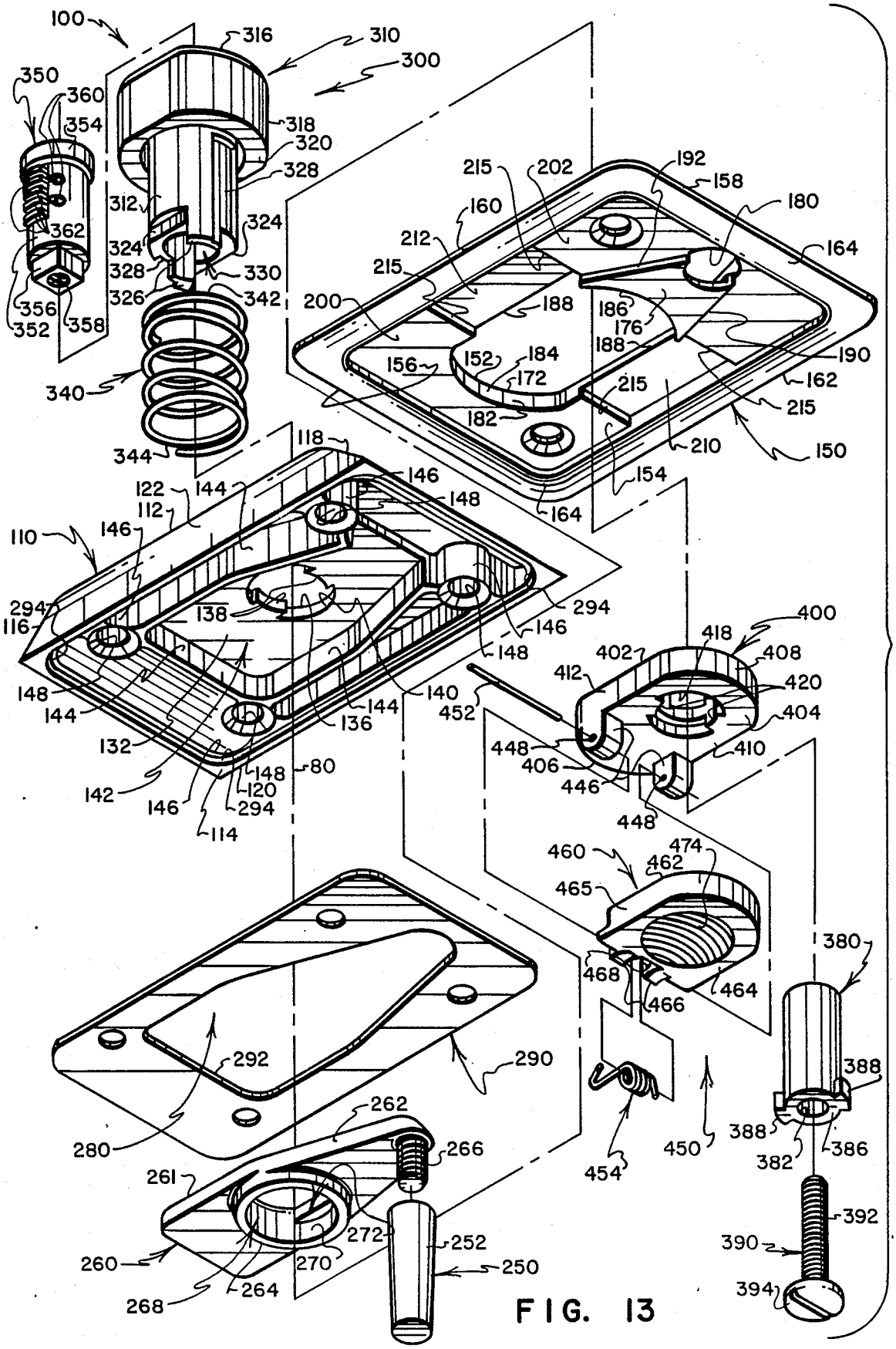
FIG. 13 is an exploded perspective view showing principally rearwardly facing portions of components of the lock.

Referring to FIGS. 13 and 14, by way of brief overview, the lock 100 includes front and rear housing members 110, 150 that clampingly engage the front and rear faces 62, 64 of the door panel 60, respectively. The lock 100 also includes the latch bolt formation 250 which projects rearwardly through an opening 180 that is formed in the rear housing member 150, a latch bolt member 260 that supports the latch bolt formation 250 for movement relative to the housing members 110, 150, a latching member 275 that cooperates with the rear housing member 150 to releasably retain the latch bolt member 260 and the latch bolt formation 250 in their "latched" position, and other components that comprise what can be viewed as an "operating mechanism" for 1) moving the latch bolt formation 250 between its rearwardly projected or "latched" position (shown in FIGS. 2, 4–7 and 10), and its relatively retracted or "unlatched" position (shown in FIGS. 9, 11 and 12), and 2) for rotating the latching member 275 about the axis 80 relative to the rear housing member 150 (between a "latching" position shown in FIGS. 4–7 and an "unlatching" position shown in FIGS. 8–12) so as to selectively retain the latch bolt member 260 and the latch bolt formation 250 in their "latched" position.

The operating mechanism includes two operating devices 300, 450, either of which can be utilized (1) to effect latching and unlatching movements of the latch bolt formation 250, and (2) to rotate the latching member 275 relative to the rear housing 150. The first operating device 300 includes the push button 310, a key cylinder 350 that is carried by the push button 310, and a sleeve member 380 that drivingly connects the key cylinder 350 with the latching member 275. The push button 310 and the key cylinder 350 are accessible from the front side of the door 30 for operating the lock 100 from the front side of the door 30. The second operating device 450 includes a foldable operating handle 460 that is pivotally attached to the latching member 400. The handle 460 is accessible from the rear side of the door 30 when the door 30 is in its closed position for operating the lock 100 from the rear side of the door 30.

Turning now to a more detailed discussion of the components of the lock 100, and referring principally to FIGS. 13 and 14, the front housing member 110 is of generally rectangular shape, having a front face 112, a rear face 114, left and right end surfaces 116, 118, and top and bottom surfaces 120, 122. The front and rear faces 112, 114 are generally rectangular in shape and extend in substantially parallel planes. The rear face 114 is longer than the front face 112. The end surfaces 116, 118 are inclined with respect to the planes of the front and rear faces 112, 114. The top and bottom surfaces 116, 118 extend substantially parallel to each other, but are rounded in the vicinities of their junctures with the front face 112 (indicated by the numeral 119 in FIG. 14).

An oblong recess 130 opens centrally through the front face 112 of the front housing member 110. The recess 130 is defined by a back wall 132 that parallels the front face 112, and by a curved side wall 134 that extends in a ring-like fashion about the back wall 132. The side wall 134 interconnects the back wall 132 with the front face 112. An opening 136 (referred to later in this document as the "front opening") is formed through the back wall 132 at a location that is centered within the oblong recess 130. The opening 136 is circular in cross section except where a pair of opposed tab formations 138 project radially inwardly toward each other. The circular portions of the opening 136 extend coaxially about the axis 80.

The front housing member 110 is preferably formed as a molded one-piece structure from plastics material. The front housing member 110 is "hollow" in the sense that it provides a single thin wall 140 of plastics material which defines not only the front face 112 but also the end surfaces 116, 118, the top and bottom surfaces 120, 122, and the walls 132, 134 of the recess. By this arrangement, the housing member 110 defines a largely hollow, cavernous interior that opens rearwardly, through the rear face 114. As is best seen in FIG. 13, a rearwardly facing central cavity 142 is defined behind the back wall 132 and behind portions of the front face 112 and the right end surface 118. The opening 136 opens into the central cavity 142. A generally U-shaped rib 144 surrounds portions of the central cavity 142 and connects with four post-like formations 146 through which mounting holes 148 are formed to receive threaded fasteners (such as the mounting screws 149 that are depicted in FIG. 3). While the mounting holes 148 are depicted as extending through the front face 112, the holes 148 need not open through the front face 112 (and preferably do not open through the front face 112 if the lock 100 is being utilized without an overlying member such as the handle 70 that covers the front face 112).

Referring still to FIGS. 13 and 14, the rear housing member 150 is of generally rectangular shape, having a front face 152, a rear face 154, left and right edge surfaces 156, 158, and top and bottom edge surfaces 160, 162. The front and rear faces 152, 154 are of generally rectangular shape, but are of relatively complex configuration in that each includes recessed and projecting portions, as will be explained. Corner junctions of the edge surfaces 156, 158, 160, 162 are rounded. Adjacent the edge surfaces 156, 158, 160, 162 is a rim formation 164 that perimetrically surrounds other portions of the front and rear faces 152, 154.

As is best seen in FIG. 14, the front face 152 includes a generally planar front wall 172 that projects forwardly from but is perimetrically surrounded by the rim formation 164. A recess 174 opens through the front wall 172, and is defined in part by a back wall 176 that extends substantially parallel to the front wall 172. A circular hole 180 is formed through the rear housing member 150 at the right end of the recess 174. A rounded-end slot 182 (referred to later in this document as the "rear opening") is formed centrally through the rear housing member 150 and opens into the recess 174. The slot 182 has curved left and right end surfaces 184, 186 that are interconnected by a pair of parallel side surfaces 188. A pair of inclined walls 190, 192 extend leftwardly from the circular hole 180 at the right end of the recess 174 and join with the surfaces 188.

Referring principally to FIG. 13, the rear surface 154 includes left and right surface portions 200, 202 that extend in a common plane which parallels the plane of the front wall 172, and central surface portions 210, 212 that extend in a common plane that is located closer to the plane of the front face of the front wall 172 than is the plane of the surface portions 200, 202. Stated in another way, the front wall 172 is thicker toward its left and right end regions (where the left and right surface portions 200, 202 are defined), and is thinner toward its central regions (where the central surface portions 210, 212 are defined). Junctures between the left and right surface portions 200, 202 and the central portions 210, 212 are provided by shoulder wall formations 215 (which serve as "stop" formations to assist in retaining the latching member 400 in its "latching" position, as will be explained).

Referring still to FIGS. 13 and 14, the latch bolt member 260 is preferably formed as a casting from metal, and includes an elongate body portion 262 that defines a centrally located hub 264 and has a rearwardly extending projection 266 near one end of the body 262. A central passage 268 is formed through the hub 264. The central passage 268 is circular in cross section toward its rearward end (as is indicated by the numeral 270 in FIG. 13), and has a pair of opposed flats 272 that define opposite sides of the passage 268 toward its forward end.

Referring principally to FIG. 14, the latch bolt formation 250 is defined by a molded plastic cap 252 that has an open end 254 which opens forwardly to receive in mating engagement the rearwardly extending projection 266. In preferred practice, the cap 252 is rigidly mounted on the projection 266. By utilizing caps 252 of selected lengths, the requirements that are encountered in a variety of circumstances wherein the lock 100 may be installed can be accommodated.

A feature of the lock 100 resides in its utilization of the opening 90 that is formed through the door panel 60, in combination with the central chamber 142 that is defined by the front housing member 110 and the recess 174 that is defined by the rear housing member 150 to define a compartment (indicated generally by the numeral 280) that houses the body 262 of the latch bolt member 260. The configuration of the compartment 270 basically conforms to the shape of the body 262 of the latch bolt member 260 so as to loosely but securely house the body 262, and to assist in preventing rotation of the latch bolt member 260 about the axis 80 relative to the housing members 110, 150, while permitting the latch bolt member 260 to move forwardly and rearwardly relative to the housing members 110, 150 to position the formation 250.

If desired, the lock 100 can be provided with a moisture resistant gasket 290 interposed between the front housing member 110 and the front face 62 of the door panel 60. As is depicted in FIGS. 13 and 14, the gasket 290 is of generally rectangular configuration and has a central passage 292 formed therethrough of an adequate size to assure that the material of the gasket 290 does not extend into the compartment 280. For purposes of receiving and retaining the gasket 290, a rectangular recess 294 is provided in the rear wall 114 of the front housing 110 (as is best seen in FIG. 13).

The push button 310 is a one-piece member that is formed from molded plastics material. The push button 310 has a generally tubular stem 312 that extends coaxially along the axis 80 through the front opening 136 of the front housing member 110. The button 310 has an enlarged head formation 314 at the forward end region of the tubular stem 312. The enlarged head formation 314 is of oblong shape, with the oblong shape corresponding to the oblong shape of the recess 130 that is formed in the forward housing member 110. The size of the head formation 314 is made small enough to allow the head formation 314 to slip easily into the recess 130.

The enlarged head formation 314 defines a flat front surface 316 that is rounded at its periphery and joins with a skirt 318 that extends rearwardly in coaxial relationship with the stem 312 but spaced radially outwardly from the stem 312. The skirt 318 terminates in a rearwardly facing edge surface 320 that is engageable with the back wall 132 of the recess 130 when the button 310 is pushed rearwardly to the full limit of its travel along the axis 80.

Figure 5:
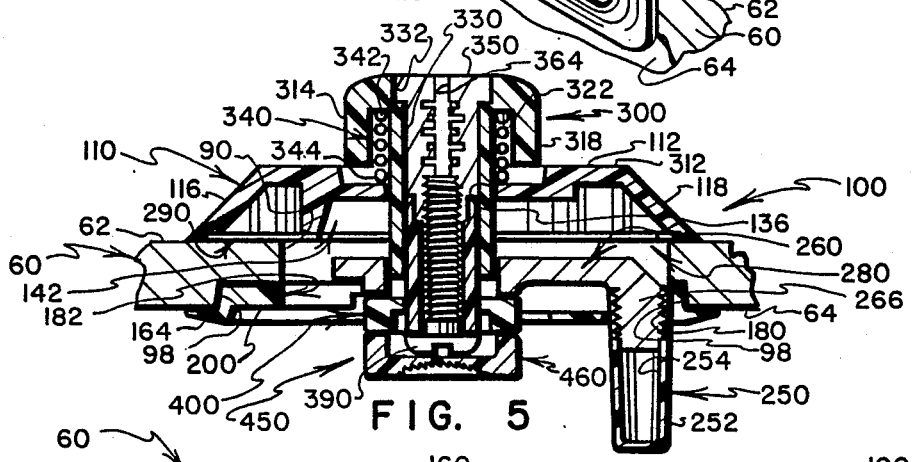
FIG. 5 is a is a sectional view, on an enlarged scale, as seen from a plane indicated by a line 5—5 in FIG. 1.
Figure 6:
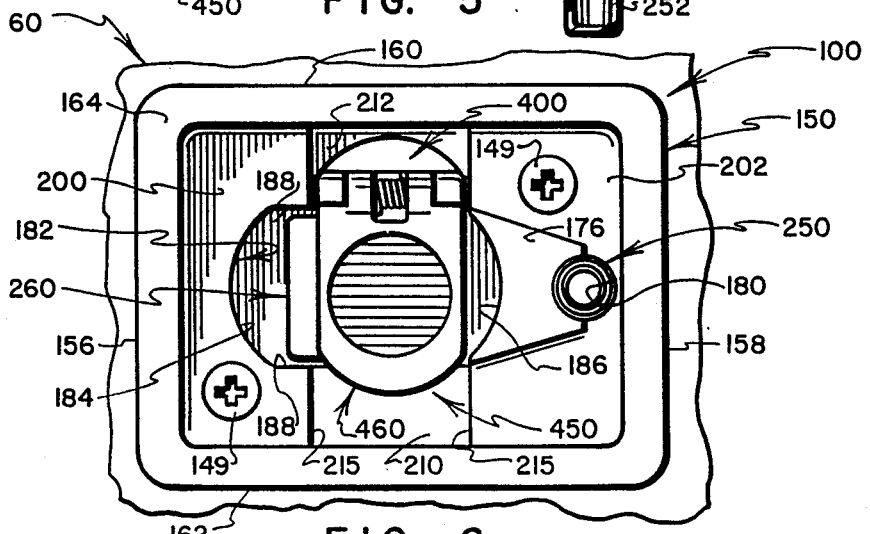
FIG. 6 is a rear elevational view of the lock and of surrounding portions of the door, with components of the lock positioned as in FIGS. 1–5.
Figure 7:
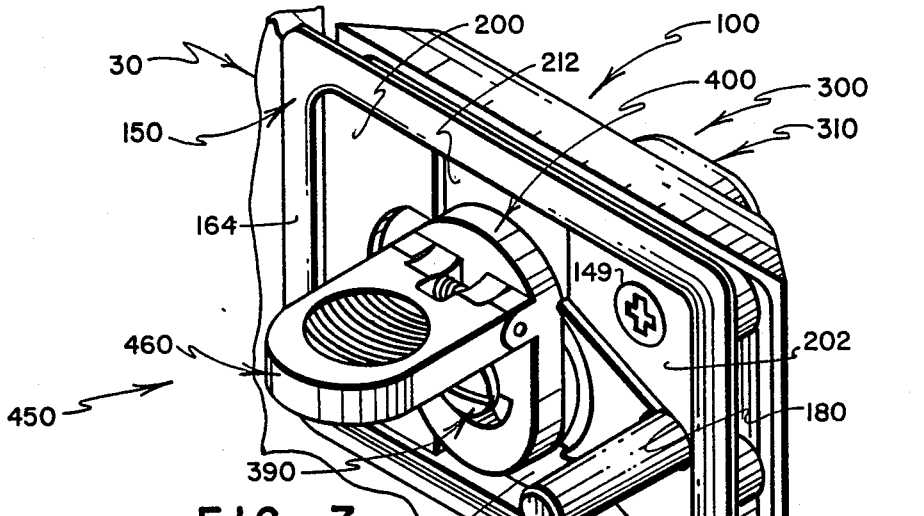
FIG. 7 is a perspective view similar to FIG. 4 but with a foldable operating handle extended rearwardly so as to be grasped for rotating the latching member of the lock.
Figure 8:
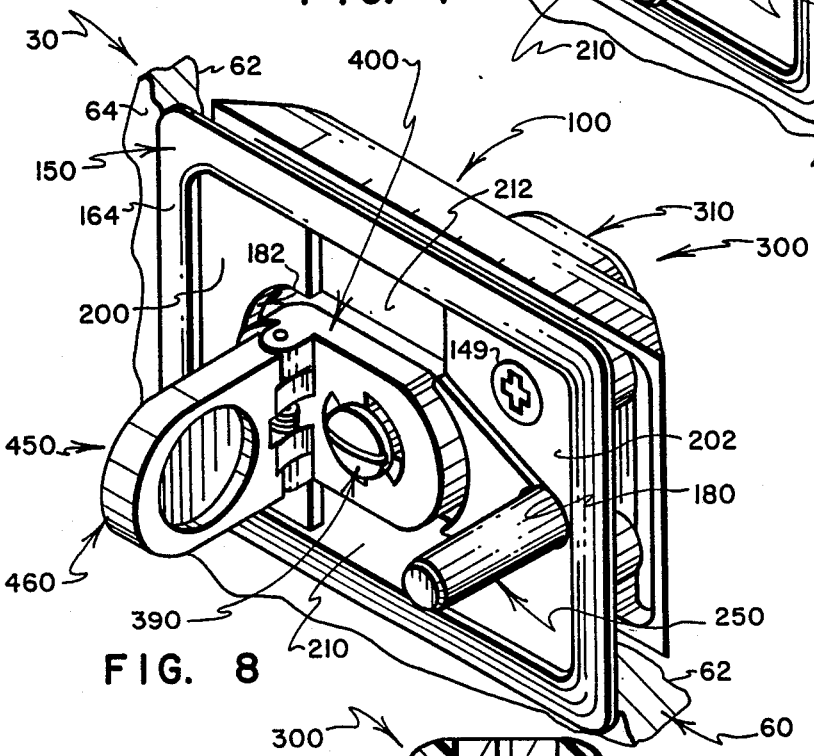
FIG. 8 is a perspective view similar to FIG. 8 but with the operating handle rotated with the latching member to its "unlatching" position, and with the latching formation in its "latched," position.

Referring to FIG. 5, the enlarged head formation 314 defines an annular, rearwardly facing surface 322 that is located between the skirt 318 and the stem 312 near the front ends thereof. A compression coil spring 340 extends about the stem 312. A forward end 342 of the spring 340 engages the annular surface 322. A rearward end 344 of the spring 340 engages the back wall 132 of the front housing recess 130. By this arrangement, the spring 340 biases the push button 310 forwardly along the axis 80 relative to the front and rear housing members 110, 150.

Referring once again to FIGS. 13 and 14, the rear end region of the stem 312 is connected rigidly to the body 262 of the latch bolt member 260 for forward and rearward movement along the axis 80 in unison with the latch bolt member 260. A pair of flat surfaces 324 are defined on opposite sides of the stem 312 in the vicinity of the end region 316. The flat surfaces 324 matingly engage the flat surfaces 272 that are provided near the forward end region of the central opening 268 that is formed through the body portion 262 of the latch bolt member 260 to drivingly connect the push button 310 and the latch bolt member 260 (i.e., to prevent the push button 310 from rotating about the axis 80 relative to the latch bolt member 260). At the forward ends of the flat surfaces 324, radially extending shoulder formations 325 are provided for engaging the forwardly facing surface 261 of the body 262 of the latch bolt member 260 so as to define the extent to which the rear end region 316 of the stem 312 is inserted into the central opening 268 of the hub portion 264 of the latch bolt member 260.

The rear end region 316 of the stem 312 of the button 310 has a pair of stop formations 326 that extend rearwardly from opposite sides of the tubular stem 312 (i.e., the stop formations 326 extend rearwardly along opposite sides of the axis 80). The stop formations 326 extend into the circular rearward end region of the passage 268 that is formed through the hub 264 of the latch bolt member 260. The stop formations 326 cooperate with a set of stop formations 410 that project forwardly from the latching member 400 (see FIG. 14) to define a quarter-turn range of relative movement that is permitted between the latching member 400 and the push button 310, as will be explained.

The tubular stem 312 of the button 310 has a pair of grooves 328 on opposed sides thereof that extend from the rear end region 316 to the vicinity of the rear wall 320 of the skirt 318. The grooves 328 receive the opposed tabs 138 that extend into the front opening 136 of the front housing member 110. The engagement of the tabs 138 with the grooves 328 helps to assure that the push button 310 does not rotate about the axis 80 relative to the front and rear housing members 110, 150; and, inasmuch as the latch bolt member 260 is restrained (by the engagement of the the flat surfaces 324 with the flat surfaces 272) from rotating about the axis 80 relative to the push button 310, the engagement of the tabs 138 with the grooves 328 also helps to assure that the latch bolt member 260 does not rotate about the axis 80 relative to the front and rear housing members 110, 150.

The tubular stem 312 of the button 310 has a passage 330 that extends centrally therethrough about the axis 80. The passage 330 is of substantially uniform diameter except near its forward end where an enlarged diameter end region 332 is provided (see FIG. 14), with a pair of grooves 334 being provided in opposed wall portions of the passage 330 to extend rearwardly from the enlarged diameter end region 332 to coact with radially projecting tumblers 358 of the key cylinder 350 to lock the key cylinder 350 against rotation relative to the push button 310, as will be explained.

The key cylinder 350 is of a conventional, commercially available type having a generally tubular body 352 that extends into the passage 330 in a slip fit so as to be rotatable therein relative to the push button 310. The body 352 has an enlarged diameter head portion 354 that is receivable in a slip fit within the enlarged diameter end region 332. A rearwardly extending drive formation 356 of square cross section is provided at the rear end of the body 352. A threaded hole 358 is provided in the drive formation 354 (see FIG. 13).

As is conventional with key cylinders of the type that is indicated by the numeral 350, the body 352 is provided with radially (or diametrically) extending grooves 360 that carry plurality of spring projected tumblers 362, and an axially extending key-receiving passage 364 that is configured to receive an appropriately formed key 365 (see FIGS. 1 and 3). When the key 365 is inserted into the passage 364 (as s shown in FIG. 3), the engagement that takes place between the key 365 and the tumblers 362 causes the tumblers 362 to be withdrawn from extending into the grooves 334. However, when the key 365 is withdrawn from the passage 364, the spring-projected tumblers 362 are biased radially outwardly to project beyond the ends of their grooves 360 for engaging one of both of the grooves 334 that are provided in the passage 330 of the push button 310. By this arrangement, when the key 365 is inserted into the key-receiving passage 364 to "unlock" the key cylinder 350 as by withdrawing the tumblers 362 into their grooves 360, the key cylinder 350 is thereby permitted to rotate relative to the push button 310. When the key 365 is removed from the key cylinder 350, the tumblers 362 engage one or both of the grooves 334 so as to "lock" the key cylinder 350 against rotating relative to push button 310.

Referring still to FIGS. 13 and 14, the sleeve 380 is a generally tubular member that has a passage 382 formed centrally therethrough to receive the threaded body 392 of a threaded fastener 390 in a slip fit so that the threaded fastener 390 can be rotated relatively easily within the passage 382. Referring to FIG. 14, the passage 382 has a forward end region that is enlarged for a short distance to provide a formation 384 that snugly mates with the drive formation 354 that is provided on the rear end of the body of the key cylinder 350. The rear end of the sleeve 380 has a radially extending surface 386 that is engaged by a head portion 394 of the fastener 390 when the fastener 390 is inserted through the passage 382 and is tightened into the threaded hole 356 that is provided in the body of the key cylinder 350. By this arrangement, the sleeve 380 is rigidly connected to the body of the key cylinder 350 for rotation therewith about the axis 80.

A pair of drive formations 388 extend from opposite sides of the rear end region of the sleeve 380. As will be explained, the drive formations 388 are engageable with drive formations 420 that are defined within a central passage 418 of the latching member 400. The drive formations 388, 420 cooperate to define a quarter-turn range of permitted relative rotation between the latching member 400 and the key cylinder 350—so as to establish a "lost motion connection" between the latching member 400 and the key cylinder 350, as will be explained in greater detail in conjunction with FIGS. 15 and 16.

Figure 15:
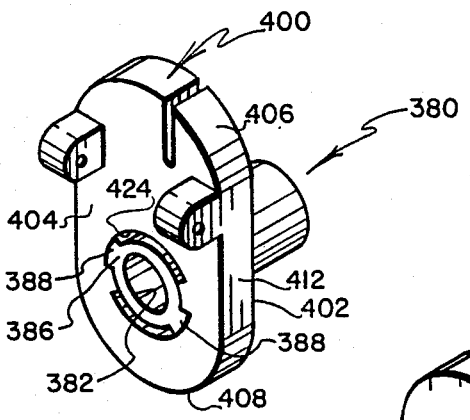
FIG. 15 is a perspective view, on an enlarged scale, showing one relative position of a sleeve and a latching component that are used in the lock of FIGS. 1–14.
Figure 16:
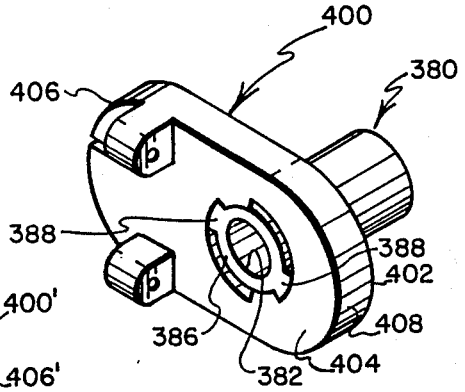
FIG. 16 is a perspective view similar to FIG. 15 but showing another relative position thereof.

Referring to FIGS. 15 and 16, the end surface 386 of the sleeve 380 is shown, together with the radially extending drive formations 388; and, the rear surface 404 of the latching member 400 is shown, together with the radially extending drive formations 420. In FIG. 15, the position of the sleeve 380 and the position of the latching member 400 are the same as the positions that these elements assume in the illustration of FIG. 7. In FIG. 16, the position of the sleeve 380 and the position of the latching member 400 are the same as the positions that these elements assume in the illustration of FIG. 8.

As is illustrated in FIG. 15, the latching member 400 is at one end of its range of relative movement with respect to the sleeve 380 inasmuch as one of two opposed sides of each of the drive formations 388 is in engagement with one of two opposed sides of the drive formations 420. As is illustrated in FIG. 16, the latching member 400 is at the other end of its range of relative movement with respect to the sleeve 380 inasmuch as the other of the two opposed sides of each of the drive formations 388 is in engagement with the the other of the two opposed sides of the drive formations 420. By comparing the relative positions of the latching member 400 in FIGS. 15 and 16, it will be seen that the range of relative movement that is defined by this "lost motion connection" which drivingly connects the sleeve 380 with the latching member 400 is a quarter turn of rotation. And, inasmuch as the sleeve 380 is rigidly connected to the key cylinder 350 for rotation therewith about the axis 80, it will be understood that the lost motion connection which is defined by the drive formations 388, 420 permits a quarter turn of relative rotation between the key cylinder 350 and the latching member 400.

Turning now to a discussion of the details of construction of the latching member 400, and referring principally to FIGS. 13 and 14, the latching member 400 has a front surface 402 and a rear surface 404 that extend in substantially parallel planes. A generally oblong side surface that includes a pair of curved ends 406, 408 which are interconnected by a pair of straight sides 410, 412 extends perimetrically about the front and rear surfaces 402, 404. The oblong configuration of the latching member 400 (as it is defined by the surface portions 406, 408, 410, 412) is shaped to correspond to the oblong shape of the rear opening 182 that is formed through the rear housing member 150, but is sized to permit the latching member 400 to pass through the rear opening 182 in a slip fit.

The distance between the straight sides 410, 412 of the latching member 400 is selected to enable the latching member 400 to be received between the stop formations 215 that are defined on the rear face 154 of the rear housing member 150 (at the junctures of the surface portions 210, 212 with the surface portions 200, 202). By this arrangement, when the latching member 400 is rotated to its latching position, as is depicted in FIGS. 4—7, the stop formations 215 coact with the straight sides 410, 412 to releasably restrain the latching member 400 from rotating about the axis 80 (i.e., the latching member 400 is thereby releasably retained in its latching position).

Referring again to FIGS. 13 and 14, the latching member 400 has a central passage 418 formed therethrough which extends along the axis 80. As is best seen in FIG. 14, the forward end region of the passage 418 is of generally circular cross section, as is indicated by the numeral 416. As is best seen in FIG. 13, the rearward end of the passage 418 is of enlarged diameter, as is indicated by the numeral 424, except for the provision of the drive formations 420 that project into the enlarged diameter portion 424 of the passage 418.

Referring to FIG. 14, the stop formations 410 (which have previously been described as interacting with stop formations 326 that are defined on the rear end region of the stem 312 of the button 310 to limit the rotation of the latching member 400 relative to the button 310 to a quarter-turn) extend forwardly and project into the passage 268 that is formed through the latch bolt hub 264.

Figure 17:
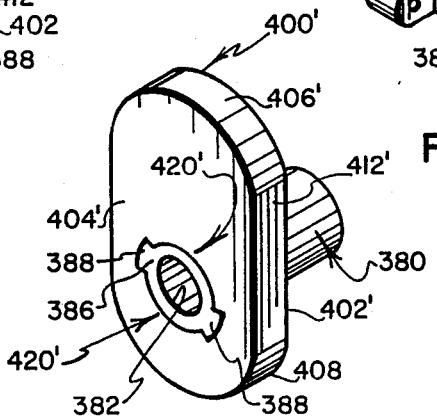
FIG. 17 is a perspective view of an alternate form of latching component.

If the lock 100 does not need to include a capability for being operated from behind the door 10, there is no need to provide the operating handle 460. In such an event, a latching member 400′ of the form that is depicted in FIG. 17 preferably is utilized. Such portions of the latching member 400′ as correspond to portions of the latching member 400 are indicated by the same numerals as are used with the latching member 400, but having "prime" marks associated therewith. Referring to FIG. 17, the latching member 400′ differs from what has been described above only in that its drive formations 420′ are configured to snugly receive the drive formations 388 of the sleeve 380 so as to provide no "play" or "lost motion" in the connection between the sleeve 380 and the latching member 400′. By this arrangement, the latching member 400′ is constrained to rotate about the axis 80 in unison with the key cylinder 350, and so rotate independently therefrom.

If the lock 100 needs to include a capability for being operated from behind the door 10, the operating handle 460 is provided. Referring to FIGS. 13 and 14, in order to pivotally connect the operating handle 460 to the latching member 400, a pair of rearwardly extending projections 446 are provided which have aligned holes 448 formed therethrough to receive a pivot pin 452, with a torsion coil spring 454 being carried on the pivot pin 452 at a location between the projections 446.

The handle 460 has a front surface 462, a rear surface 464, and a side wall 465 that extends about and perimetrically connects the front and rear surfaces 462, 464. The handle 460 has a pair of formations 466 through which aligned holes 468 are formed to receive the pivot pin 452. With the pivot pin 452 installed to pivotally connect the handle 460 with the latching member 400 (as is depicted in FIGS. 4–12), the torsion coil spring 454 functions to bias the handle 460 away from its rearwardly extended position (shown in FIGS. 7–10) toward its retracted position (shown in FIGS. 4–6, 11 and 12).

As is best seen in FIG. 14, the front surface 462 of the handle 460 has a depression 472 formed therein to receive the head 394 of the fastener 390 when the handle 460 is in its retracted position. As is best seen in FIG. 13, the rear surface 462 of the handle 460 has a ribbed depression 474 formed therein to provide a gripping surface that will assist an operator in grasping the handle 460 when the handle has been pivoted to its rearwardly extended position.

When the lock 100 is "unlatched," the latch bolt member 260 (together with the latch bolt formation 250) is in its forward, retracted position, and the latching member 400 (together with the foldable handle 460) is received within the confines of the rear opening 182 that is formed through the rear housing member 150. When the lock 20 is "latched," the latch bolt member 260 (together with the latch bolt formation 260) is in its rearward, projected position, and the latching member 400 (together with the foldable handle 460) is turned a quarter turn so as to extend behind (and to be blocked from moving forwardly by) the central portions 210, 212 of the rear face 154 of the rear housing member 150.

Stated in another way, the door 30 is "latched" by a combination of (1) causing the latch bolt formation 250 to move rearwardly relative to the door 30 to a sufficient extent to block opening movement of the door 30, and (2) causing the latching member 400 to extend across portions of the rear face of the rear housing member 150 so as to prevent forward movement of the latch bolt member 260 (and the latch bolt formation 250 that is carried thereby). The door 30 is "unlatched" by a combination of 1) causing the latching member 400 to align with the oblong rear opening 182 that is formed in the rear housing member 150 so as to be movable into the opening 182, and 2) moving latch bolt member 260 forwardly to withdraw the latch bolt formation 250 into the hole 180 that is formed through the rear housing member 150—so that the latch bolt formation 250 no longer blocks opening movement of the door 30.

A feature of the described lock 100 is that it can be "operated" so as to latch or unlatch the door 30 either by operating the key 365 in the key cylinder 350 (together with moving the push button 310 rearwardly to position the latching member 400 so that it can be rotated at a location behind the rear surface 154 of the rear housing member 150), or by utilizing the handle 460 to move the latching member 150 to effect the needed latching and unlatching movements of the latching member 150. A further feature of the described lock 100 resides in the lost motion connection that is provided between the latching member 400 and the key cylinder 350 so as to enable the handle 460 to rotate the latching member 400 through the needed quarter turn range of movement to effect latching and unlatching without disturbing the position of the key cylinder 350.

While a key cylinder 350 has been described as being carried by the push button 310, whereby the resulting structure is a key-operated unit of the type that is referred to in the art as a "lock," those skilled in the art will readily appreciate that, in place of the key cylinder 350, a tool-operated rotary unit (not shown), or a simple knob unit (not shown) may be substituted for the key cylinder 350 so as to provide a "latch" instead of a "lock." Thus it will be understood that features of the present invention are applicable to both "latch" and "lock" type units.

Figure 18:
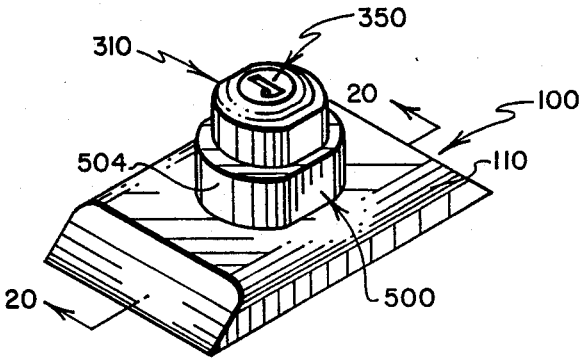
FIG. 18 is a perspective view showing forwardly facing portions of the lock of FIGS. 1-14 together with a shrouding component, with the operating button of the lock in its normal extended position.
Figure 19:
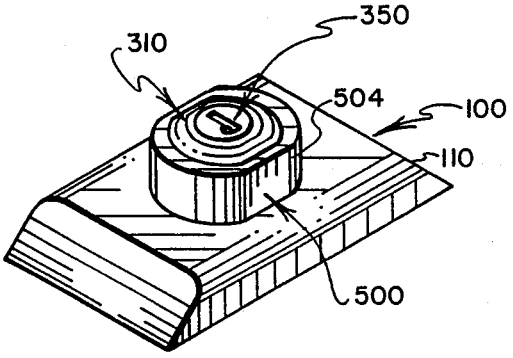
FIG. 19 is a perspective view similar to FIG. 18 but with the button moved rearwardly; and, FIG. 20 is a sectional view from a plane indicated by a line 20—20 in FIG. 18.
Figure 20:
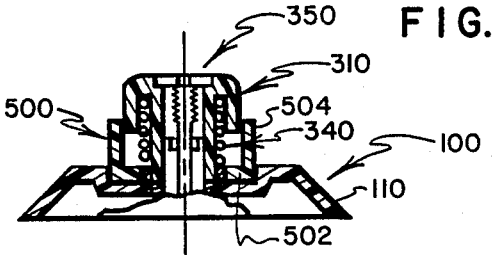

To complete a description of features of the present invention, reference is made briefly to FIGS. 18–20 which illustrate, although somewhat schematically, that, in place of the handle 70, a simple forwardly facing cup-shaped member 500 may be utilized to protectively shroud the push button 310. In FIG. 20, the cup-shaped member 500 is shown as having a back wall 502 that is nested within the recess 130 of the front housing member 110, with a forwardly extending side wall 504 that receives the push button 310 in a slip fit. The side wall 504 preferably is configured to not extend beyond the push button 310 when the button 310 is depressed, as is shown in FIG. 19; however, as is illustrated in FIG. 18, the side wall 504 cooperates with the forward end region of the push button 310 to assure that the region about the compression coil spring 340 is protectively enclosed even when the button 310 is in its normally extended position.

Although the invention has been described in its preferred form with a certain degree of particularity, it is understood that the present disclosure of the preferred form is only by way of example, and that numerous changes in the details of construction and the combination and arrangements of parts and the like may be resorted to without departing from the spirit and scope of the invention as hereinafter claimed. While "orientation terms" such as "upwardly," "downwardly," "rightwardly," "leftwardly," "forwardly," "rearwardly" and the like have been utilized in describing the invention, these terms should not be interpreted as being limiting. It is intended that the patent shall cover by suitable expression in the appended claims, whatever features of patentable novelty exist in the invention disclosed.

What is claimed is:

1. A latch for mounting on front and rear faces of a closure that is movable from side-to-side with respect to structure located behind the closure, and with the latch having a latch bolt formation that is projectable behind the closure to releasably engage structure located behind the closure to releasably retain the closure in a closed position, comprising:

(a) front housing means including a front housing member for mounting on a front face of a closure adjacent an opening that is formed through the closure;

(b) rear housing means including a rear housing member for mounting on a rear face of the closure adjacent the opening;

(c) compartment formation means defined by facing portions of the front housing member and by forwardly facing portions of the rear housing member, for cooperating with the opening that is formed through the closure to provide a compartment for housing a latch bolt member;

(d) aligned opening means including a front opening formed substantially centrally through the front housing member and communicating with the compartment, and a rear opening formed substantially centrally through the rear housing member and communicating with the compartment, with the front and rear openings being aligned along an imaginary axis that extends forwardly and rearwardly with respect to the closure, and with the rear opening being of elongate configuration;

(e) a latch bolt opening formed through the rear housing member and communicating with the compartment at a location spaced from the axis of the aligned front and rear openings;

(f) latch bolt means including a latch bolt member having an elongate body for being positioned within the compartment, and having rearwardly projecting means including a latch bolt formation for extending through the latch bolt opening to project rearwardly from the rear housing member, with the body of the latch bolt member being movable forwardly and rearwardly within the compartment to selectively position the latch bolt member in a "latched" position wherein the latch bolt formation is relatively "projected" with respect to the rear housing member, and an "unlatched" position wherein the latch bolt formation is relatively "retracted" with respect to the rear housing member;

(g) push button means connected to the latch bolt member for moving forwardly and rearwardly therewith relative to the front and rear housing members, including a button member having a stem that projects forwardly from the latch bolt member and through the front opening to provide structure that is accessible from the front of the latch for moving the latch bolt member relatively forwardly and rearwardly with respect to the front and rear housing members;

(h) biasing means for biasing the latch bolt member and the button member forwardly with respect to the front and rear housing members;

(i) latching member means connected to the latch bolt member for forward and rearward movements therewith, including a latching member having elongate latching formation means configured (1) to be movable through the rear opening when the latching formation means is in an unlatching position wherein the latching formation means is aligned with the elongate rear opening, and (2) to block forward movement of the latching member when the elongate latching formation is in a latching position wherein the latching formation means extends behind and overlies portions of the rear housing member that reside adjacent the rear opening so as to be out of alignment with the rear opening;

(j) rotary positioning means connected to the button member and being accessible from the front of the latch for rotating the latching member means between its unlatching position of alignment with the rear opening and its latching position of non-alignment with the rear opening;

(k) whereby the latch can be operated:

(i) to "latch" the closure on which it is mounted in a closed position by causing the latch bolt formation to engage structure located behind the closure to prevent movement of the closure out of its closed position, as by moving the button member together with the latch bolt member and the latching member rearwardly in opposition to the action of the biasing means to a position wherein the latching formation means can be rotated from its unlatching position of alignment with the rear opening to its latching position of non-alignment with the rear opening; and, (ii) to "unlatch" the closure by counterrotating the latching member to align the latching formation means with the rear opening, and by moving the button member together with the latch bolt and the latching member forwardly to a position wherein the latch bolt formation disengages said structure and thereby permits the closure to be moved out of its closed position.

2. The latch of claim 1 wherein the biasing means includes a compression coil spring that is interposed between the button member and the front housing member.

3. The latch of claim 2 wherein the front housing member has a forwardly facing surface portion that is engaged by the compression coil spring, the button member has a rearwardly facing surface portion that is engaged by the compression coil spring, and the compression coil spring has coil portions that wrap about the stem of the button member.

4. The latch of claim 3 wherein the button member includes a skirt that extends coaxially about the stem at a location spaced radially outwardly therefrom, the rearwardly facing surface portion of the button member extends between the skirt and the stem, and coils of the compression coil spring extend into a space that is defined between the skirt and the stem.

5. The latch of claim 1 wherein a pair of grooves are formed in opposed sides of the stem of the button member so as to extend through the front opening in generally parallel relationship to the axis of the aligned front and rear openings, and the front housing member has tab formation means including a pair of opposed tab formations that extend into the grooves for inhibiting rotation of the button member about said axis relative to the front housing member.

6. The latch of claim 1 wherein the front housing member has front and rear surface portions that extend substantially parallel to each other, a recess is formed in the front surface portion, with the recess being defined at least in part by a back wall that extends substantially parallel to the front surface portion, the front opening opens through the back wall and into the recess, and the button member has a rearwardly facing formation that is configured to be extensible into the recess when the button member and the latch bolt member are moved rearwardly to enable the latching formation means to be rotated between its unlatching position of alignment with the rear opening, and its latching position of non-alignment with the rear opening.

7. The latch of claim 6 wherein the rearwardly facing formation of the button member is configured to be engageable with the back wall of the recess so as to limit the button member from moving farther rearwardly when the button member and the latch bolt member are moved rearwardly to enable the latching formation means to be rotated between its unlatching position of alignment with the rear opening, and its latching position of non-alignment with the rear opening.

8. The latch of claim 6 wherein the back wall is defined by a relatively thin wall formation of the front housing member that has one side which faces into the recess, and an opposed side that faces into the compartment, and the latch bolt member engages the opposed side when in its unlatched position so as to define a forward limit of the range of travel for the latch bolt member relative to the front and rear housing members.

9. The latch of claim 6 wherein the front housing has a ring-like side wall that extends between the front surface and the back wall of the recess, the ringlike side wall is of generally oblong shape having a pair of curved end portions that are connected by a pair of generally parallel extending side portions, and the rearwardly facing formation of the button member is of corresponding oblong shape so as to be received within the ringlike side wall when the button member and the latch bolt member are moved rearwardly to enable the latching formation means to be rotated between its unlatching position of alignment with the rear opening, and its latching position of non-alignment with the rear opening.

10. The latch of claim 1 wherein the elongate rear opening is defined by a pair of opposed end formations that are interconnected by a pair of opposed side formations, with the opposed end formations being spaced from each other by a greater distance than are the opposed side formations, and wherein the latching member is of corresponding elongate configuration so as to be movable through the rear opening in a slip fit as the latch bolt member is moved between its latched and unlatched positions.

11. The latch of claim 10 wherein the rear housing member includes rearwardly facing surface means defined on the rear housing member and extending about the elongate rear opening, including stop formation means located near the rear opening, and the latching formation means is configured to be engageable with the stop formation means when the latching formation means is in its latching position so as to inhibit rotary movement of the latching formation means from its latching position to its unlatching position.

12. The latch of claim 11 wherein the rearward facing surface means includes a first pair of rearwardly facing surface formations that are located adjacent the opposed end formations and extend within a common first plane, a second pair of rearwardly facing surface formations that are located adjacent the opposed side formations and extend within a common second plane, with the second plane being located relatively more forwardly along the axis than is the first plane, and the stop formation means comprise formations that are situated at junctures of the first rearwardly facing surface formations and the second rearwardly facing surface formations.

13. The latch of claim 1 wherein the latching member means includes an operating handle that is accessible from behind the latch to move the latch bolt means forwardly and rearwardly between its unlatched and latched positions, and to rotate the latching formation means between its latching and unlatching positions.

14. The latch of claim 13 additionally including connection means for providing a lost motion driving connection between the rotary positioning means and the latching formation means to enable the operating handle to effect rotation of the latching formation means between its latching and unlatching positions without causing corresponding rotary movement of the rotary positioning means.

15. The latch of claim 14 wherein the rotary positioning means includes key cylinder means connected through the lost motion driving connection to the button member for rotating the latching formation means between its unlatching and latching positions in response to operation of the key cylinder means by an appropriately configured key.

16. The latch of claim 13 wherein the operating handle includes a pair of pivotally connected members, one of which extends in a plane that is transverse to the axis of the aligned openings and defines the latching formation means, the other of which is movable from a nested position overlying the one member to an operating position projecting rearwardly from the rear housing member so as to be readily grasped by an operator.

17. The latch of claim 16 additionally including a pivot pin that extends through aligned holes formed in the one and other members of the operating handle to effect a pivotal connection therebetween, and a torsion coil spring is interposed between the one and other members to bias the members toward their nested position.

18. The latch of claim 1 wherein the latch bolt means has its body formed from metal, with at least a portion of the latch bolt formation being formed from plastics material that projects rearwardly from the body.

19. The latch of claim 1 additionally including fastener means for connecting the front housing member to the rear housing member to assist in securely mounting the front and rear housing members on the closure adjacent the opening that is formed through the closure.

20. The latch of claim 19 additionally including moisture resistant gasket means for being interposed between portions of the front housing member and the front face of the closure, and wherein the fastener means functions to compress the gasket means as by clamping portions of the front housing member securely into engagement with the front surface of the closure.

21. The latch of claim 1 additionally including a forwardly facing recess defined by the front housing member in surrounding relationship to the front opening, and shroud means for extending forwardly from the recess to surround portions of the button member that are located forwardly of with respect to the front housing member.

22. The latch of claim 1 wherein forwardmost portions of the button member define an enlarged formation to facilitate the button member's being engaged by an operator to apply force thereto in a rearward direction to move the button member and the latch bolt member rearwardly with respect to the front and rear housing members, and the shroud means is configured to extend closely about the enlarged formation when the button member is moved rearwardly to enable the latching formation means to be rotated between its unlatching position of alignment with the rear opening, and its latching position of non-alignment with the rear opening.

23. A latch for mounting on a panel of a sliding or rolling closure that has front and rear faces, and that has a handle that extends across portions of the front face of the closure at a location spaced forwardly from the front face of the closure, with portions of the latch being configured to be sandwiched between the handle and the front face of the closure, with portions of the latch being configured to extend through aligned openings that are formed through the closure and through the handle, and with the latch having a latch bolt formation that is projectable behind the closure to releasably engage structure located behind the closure to releasably retain the closure in a closed position, comprising:

(a) front housing means including a front housing member for mounting between and being clampingly engaged by a front face of a closure and a rear face of a handle that extends across the front face of the closure in spaced relationship thereto, with the front housing member having a front opening formed therethrough that aligns with aligned openings that are formed through the closure and through the handle;

(b) rear housing means including a rear housing member for mounting on a rear face of the closure adjacent the opening that is formed through the closure, with the rear housing member having a rear opening formed therethrough that is aligned with the front opening and with the openings that are formed through the closure and through the handle, with such alignment being along an imaginary axis that extends substantially perpendicular to the plane of such portions of the front face as surround the opening that is formed through the closure, and with the rear opening being of elongate configuration;

(c) compartment formation means defined by rearwardly facing portions of the front housing member and by forwardly facing portions of the rear housing member, for cooperating with the opening that is formed through the closure to provide a compartment for housing a latch bolt member;

(d) a latch bolt opening formed through the rear housing member and communicating with the compartment at a location spaced from the axis of the aligned front and rear openings;

(e) latch bolt means including a latch bolt member having an elongate body positioned within the compartment, and having rearwardly projecting means including a latch bolt formation extending through the latch bolt opening to project rearwardly from the rear housing member, with the body of the latch bolt member being movable forwardly and rearwardly within the compartment to selectively position the latch bolt member in a "latched" position wherein the latch bolt formation is relatively "projected" with respect to the rear housing member, and an "unlatched" position wherein the latch bolt formation is relatively "retracted" with respect to the rear housing member;

(f) push button means connected to the latch bolt member for moving forwardly and rearwardly therewith relative to the front and rear housing members, including a button member having a stem that projects forwardly from the latch bolt member and through the front opening, and with an enlarged forward end region being provided on the button member for being accessed from the front of the latch for moving the latch bolt member relatively forwardly and rearwardly with respect to the front and rear housing members;

(g) biasing means for biasing the latch bolt member and the button member forwardly with respect to the front and rear housing members;

(h) latching member means connected to the latch bolt member for forward and rearward movements therewith, including a latching member having elongate latching formation means configured (1) to be movable through the rear opening when the latching formation means is in an unlatching position wherein the latching formation means is aligned with the elongate rear opening, and (2) to block forward movement of the latching member means when the elongate latching formation is in a latching position wherein the latching formation means extends behind and overlies portions of the rear housing member that reside adjacent the rear opening so as to be out of alignment with the rear opening;

(i) rotary positioning means connected to the button member and being accessible from the front of the latch for rotating the latching member means between its unlatching position of alignment with the rear opening and its latching position of non-alignment with the rear opening;

(j) whereby the latch can be operated:

(i) to "latch" the closure on which it is mounted in a closed position by causing the latch bolt formation to engage structure located behind the closure to prevent movement of the closure out of its closed position, as by moving the button member together with the latch bolt member and the latching member rearwardly in opposition to the action of the biasing means to a position wherein the latching formation means can be rotated from its unlatching position of alignment with the rear opening to its latching position of non-alignment with the rear opening; and, (ii) to "unlatch" the closure by counter-rotating the latching member to align the latching formation means with the rear opening, and by moving the button member together with the latch bolt and the latching member forwardly to a position wherein the latch bolt formation disengages said structure and thereby permits the closure to be moved out of its closed position.

24. The latch of claim 23 wherein a pair of grooves are formed in opposed sides of the stem of the button member so as to extend through the front opening in generally parallel relationship to the axis of the aligned front and rear openings, and the front housing member has tab formation means including a pair of opposed tab formations that extend into the grooves for inhibiting rotation of the button member about said axis relative to the front housing member.

25. The latch of claim 23 wherein the front housing member has front and rear surface portions that extend substantially parallel to each other, a recess is formed in the front surface portion, with the recess being defined at least in part by a back wall that extends substantially parallel to the front surface portion, the front opening opens through the back wall and into the recess, and the button member has a rearwardly facing formation that is configured to be extensible into the recess when the button member and the latch bolt member are moved rearwardly to enable the latching formation means to be rotated between its unlatching position of alignment with the rear opening, and its latching position of non-alignment with the rear opening.

26. The latch of claim 25 wherein the rearwardly facing formation of the button member is configured to be engageable with the back wall of the recess so as to limit the button member from moving farther rearwardly when the button member and the latch bolt member are moved rearwardly to enable the latching formation means to be rotated between its unlatching position of alignment with the rear opening, and its latching position of non-alignment with the rear opening.

27. The latch of claim 23 wherein the rear housing member includes rearwardly facing surface means defined on the rear housing member and extending about the elongate rear opening, including stop formation means located near the rear opening, and the latching formation means is configured to be engageable with the stop formation means when the latching formation means is in its latching position so as to inhibit rotary movement of the latching formation means from its latching position to its unlatching position.

28. The latch of claim 23 wherein the latching member means includes an operating handle that is accessible from behind the latch to move the latch bolt means forwardly and rearwardly between its unlatched and latched positions, and to rotate the latching formation means between its latching and unlatching positions.

29. The latch of claim 28 additionally including connection means for providing a lost motion driving connection between the rotary positioning means and the latching formation means to enable the operating handle to effect rotation of the latching formation means between its latching and unlatching positions without causing corresponding rotary movement of the rotary positioning means.

30. The latch of claim 29 wherein the rotary positioning means includes key cylinder means connected through the lost motion driving connection to the button member for rotating the latching formation means between its unlatching and latching positions in response to operation of the key cylinder means by an appropriately configured key.

31. The latch of claim 28 wherein the operating handle includes a pair of pivotally connected members, one of which extends in a plane that is transverse to the axis of the aligned openings and defines the latching formation means, the other of which is movable from a nested position overlying the one member to an operating position projecting rearwardly from the rear housing member so as to be readily grasped by an operator.

32. The latch of claim 23 additionally including fastener means for connecting the front housing member to the rear housing member to assist in securely mounting the front and rear housing members on the closure adjacent the opening that is formed through the closure.

33. The latch of claim 32 wherein the fastener means include at least two headed, threaded fasteners that are inserted through aligned holes formed through the rear housing member, the closure, the front housing means, and are threaded into threaded hole formations that are provided in the closure handle.

34. The latch of claim 23 additionally including a forwardly facing recess defined by the front housing member in surrounding relationship to the front opening, and the enlarged forward end region of the button member is configured to enable the closure handle to serve as a shroud for extending forwardly from the recess to surround portions of the button member that are located forwardly of with respect to the front housing member.

* * * * *